US009744550B2

(12) United States Patent
Andersen

(10) Patent No.: US 9,744,550 B2
(45) Date of Patent: Aug. 29, 2017

(54) WATER FOUNTAIN

(71) Applicant: Sean P. Andersen, Phoenix, AZ (US)

(72) Inventor: Sean P. Andersen, Phoenix, AZ (US)

( * ) Notice: Subject to any disclaimer, the term of this patent is extended or adjusted under 35 U.S.C. 154(b) by 0 days.

(21) Appl. No.: 14/975,741

(22) Filed: Dec. 19, 2015

(65) Prior Publication Data

US 2016/0129468 A1 May 12, 2016

Related U.S. Application Data

(62) Division of application No. 13/602,052, filed on Aug. 31, 2012, now Pat. No. 9,221,070.

(60) Provisional application No. 61/573,234, filed on Aug. 31, 2011.

(51) Int. Cl.

| | |
|---|---|
| ***B05B 17/04*** | (2006.01) |
| ***B05B 17/08*** | (2006.01) |
| *F21S 13/00* | (2006.01) |
| *F21W 121/02* | (2006.01) |

(52) U.S. Cl.

CPC ..... *B05B 17/085* (2013.01); *B05B 17/08* (2013.01); *F21S 13/00* (2013.01); *F21W 2121/02* (2013.01)

(58) Field of Classification Search

CPC ..... B05B 17/08; F21S 13/00; F21W 2121/02
USPC ..... 239/12, 17, 18, 20, 23; 119/253
See application file for complete search history.

(56) References Cited

U.S. PATENT DOCUMENTS

| | | | | |
|---|---|---|---|---|
| 3,568,927 | A * | 3/1971 | Scurlock | G09F 13/24 239/17 |
| 6,149,070 | A * | 11/2000 | Hones | B05B 1/044 239/16 |
| 2001/0036609 | A1* | 11/2001 | Ehrlich | F21V 35/00 431/253 |
| 2003/0201336 | A1* | 10/2003 | Rumens | B05B 17/08 239/17 |
| 2010/0304318 | A1* | 12/2010 | Muff | B05B 17/08 431/350 |
| 2010/0327076 | A1* | 12/2010 | Freeman | B05B 17/085 239/20 |

* cited by examiner

*Primary Examiner* — Arthur O Hall
*Assistant Examiner* — Joel Zhou
(74) *Attorney, Agent, or Firm* — The Noblitt Group, PLLC

(57) ABSTRACT

Disclosed is two-tier fountain with a continuous scupper. A continuous scupper is a 360-degree, unrestricted border (i.e., continuous), scupper in an upper basin that creates an inward flowing laminar sheet of fluid. A continuous scupper maintains a laminar flow for great distances so that the fluid falls in a circular cascade sheet. On reaching the lower basin, the fluid creates a limited amount of turbulence during entry and therefore a reduced splash. The continuous scupper may be circular, or may have simple to complex variations that create different forms of circular cascade sheets. The upper basin may be open to the atmosphere, or may be closed to create even more spectacular circular cascade sheets.

12 Claims, 9 Drawing Sheets

WATER FOUNTAIN

CROSS-REFERENCE TO RELATED APPLICATION

This application is a Divisional of U.S. Non-Provisional patent application Ser. No. 13/602,052 filed Aug. 31, 2012 and having the same title, which claims the benefit of priority of U.S. Provisional Patent Application 61/573,234 filed Aug. 31, 2011 and titled "FIRE AND WATER FOUNTAIN," the disclosure of which is incorporated by reference.

BACKGROUND OF THE INVENTION

Field of Invention

The invention relates generally to the field of fountains and more particularly to split-level live fire and water fountain displays (http://fountainsandfireusa.com).

Description of Related Art

Water fountains throughout history and worldwide have captured people's attention. Water fountains generally have a basin for capturing falling water and a pump to raise the water to a stand above the basin. The water is then sprayed or flows from the stand to an outer edge, and cascades down to the basin.

For nighttime display, some fountains have electrically secure lights within the basin, within the stand, or sometimes safely outside the water, to add sparkle or color to the fountain. Other fountains have fire displays walled away from the water or above the water to enhance the enjoyment of nighttime water displays.

Placing fire within the water flow won't work, so no one placed fire within the water flow—until Sean Andersen did and made it work.

SUMMARY OF THE INVENTION

Disclosed is a fire and water fountain for displaying fire inside a falling water cascade. The fire and water fountain receives fluid into an upper basin. The upper basin has an outer wall and a circular inner wall. The circular inner wall is lower in height than the outer wall.

A fluid distribution system removes turbulent flow so that the fluid rises laminar and clear without turbulent currents or eddies at the surface. As the fluid flows gently above the circular inner wall, the fluid flows inwardly onto a continuous scupper with a hollow center. Surface tension and gravity thin the fluid film so that the fluid film flows smoothly over the continuous scupper. The fluid film reaches the inner edge of the continuous scupper. Surface tension, viscosity and gravity pull the fluid into a circular cascade sheet with laminar streamlines that fall away from the upper basin.

Beneath the upper basin within the circular cascade sheet is a fire, such as a lit candle or gas lamp. The fire shimmers through the laminar streamlines of the circular cascade sheet. A lower basin collects the fluid. A pump and delivery tube returns the fluid to the upper basin.

Also disclosed are various embodiments of the fluid distribution system. The fluid distribution system may comprise a fluid distribution ring in the upper basin with a slot or a plurality of holes. The slot or holes may be sized relative to a flow characteristic. The slot or holes may be sized so that equal flow comes from each hole. The fluid distribution system may include a sieve or solids in the upper basin to break-up flow patterns in the water. These solids may be sized relative to the flow characteristic.

Other embodiments may include a prescupper to provide additional smoothing effects of the fluid to the continuous scupper. Other embodiments include variations of the continuous scupper to affect the flow characteristic into the circular cascade sheet.

DETAILED DESCRIPTION OF THE INVENTION

Embodiments are directed to a fire and water fountain (100).

Figure 1:
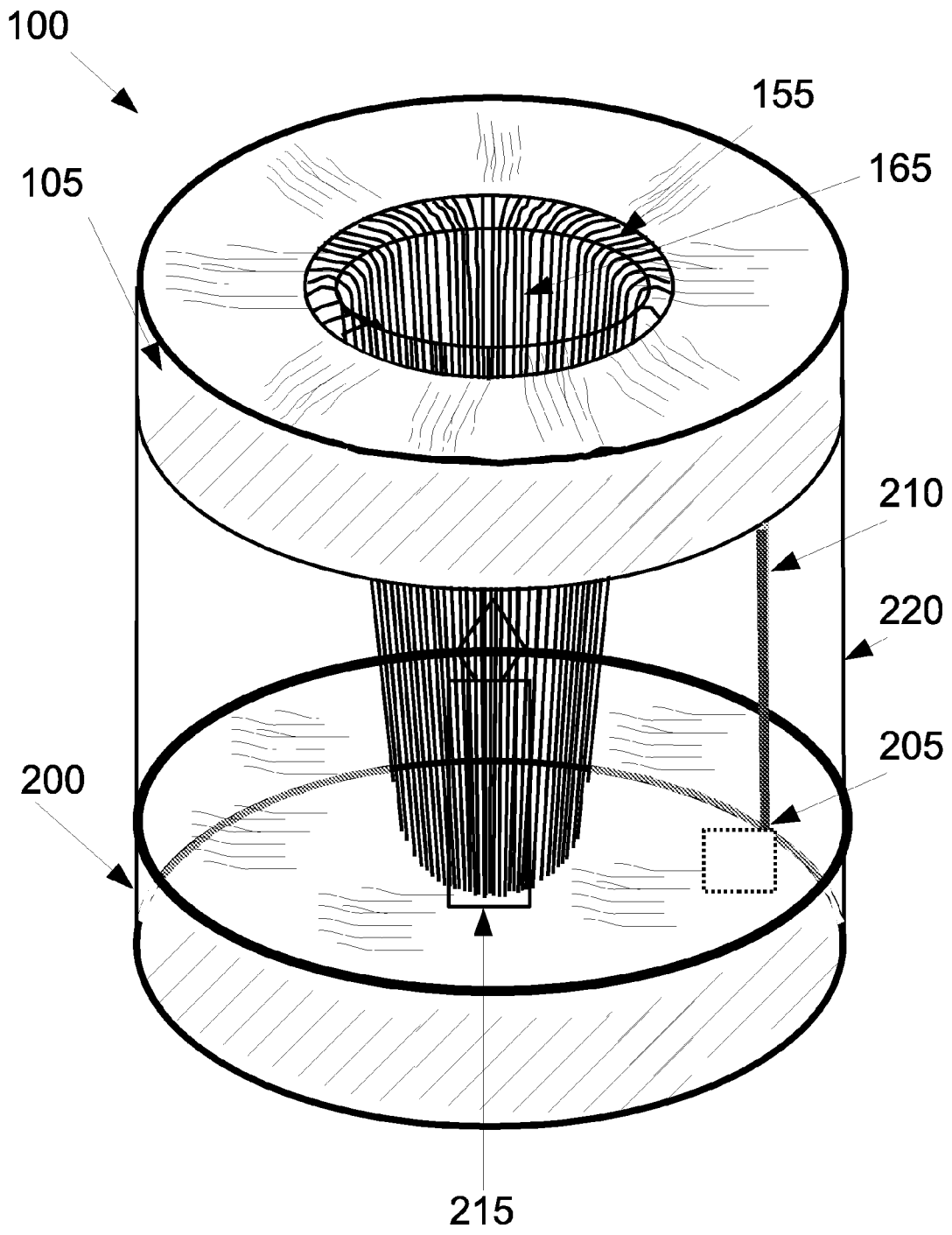
FIG. 1 shows a view of an exemplary embodiment of a fire and water fountain (100) in operation.

FIG. 1 shows portions of the components of the fire and water fountain (100) during operation. Shown in FIG. 1 are an exemplary upper basin (105), an exemplary continuous scupper (155), a cascade chamber (165), lower basin (200), a pump (205), a delivery tube (210), a fire fixture (215), and stanchions (220).

The fire and water fountain (100) receives a fluid into the upper basin (105). The upper basin (105) is a containment vessel for the fluid. In the preferred embodiment, the fluid is water.

Components within the upper basin (105), shown in other drawings, distribute the fluid throughout the upper basin (105). As the fluid fills the upper basin (105), it reaches the level of the continuous scupper (155). The height of the continuous scupper (155) is less than the height of the outer wall (shown in other drawings) of the upper basin (105). The fluid flows over the continuous scupper (155), and into the cascade chamber (165). Various embodiments of the continuous scupper (155) direct the fluid into patterns as gravity pulls the fluid downward in a circular cascade sheet.

Centrally nested beneath the upper basin (105) within the circular cascade sheet is a fire, such as a lit candle or gas lamp (215). The fire shimmers through the laminar streamlines of the circular cascade sheet.

The lower basin (200) collects the fluid. The pump (205) and delivery tube (210) return the fluid the upper basin (105). Stanchions (220) may be used to hold the upper basin (105) in place. In some embodiments, one or more delivery tubes (210) are used to hold the upper basin (105) in place.

Figure 2:
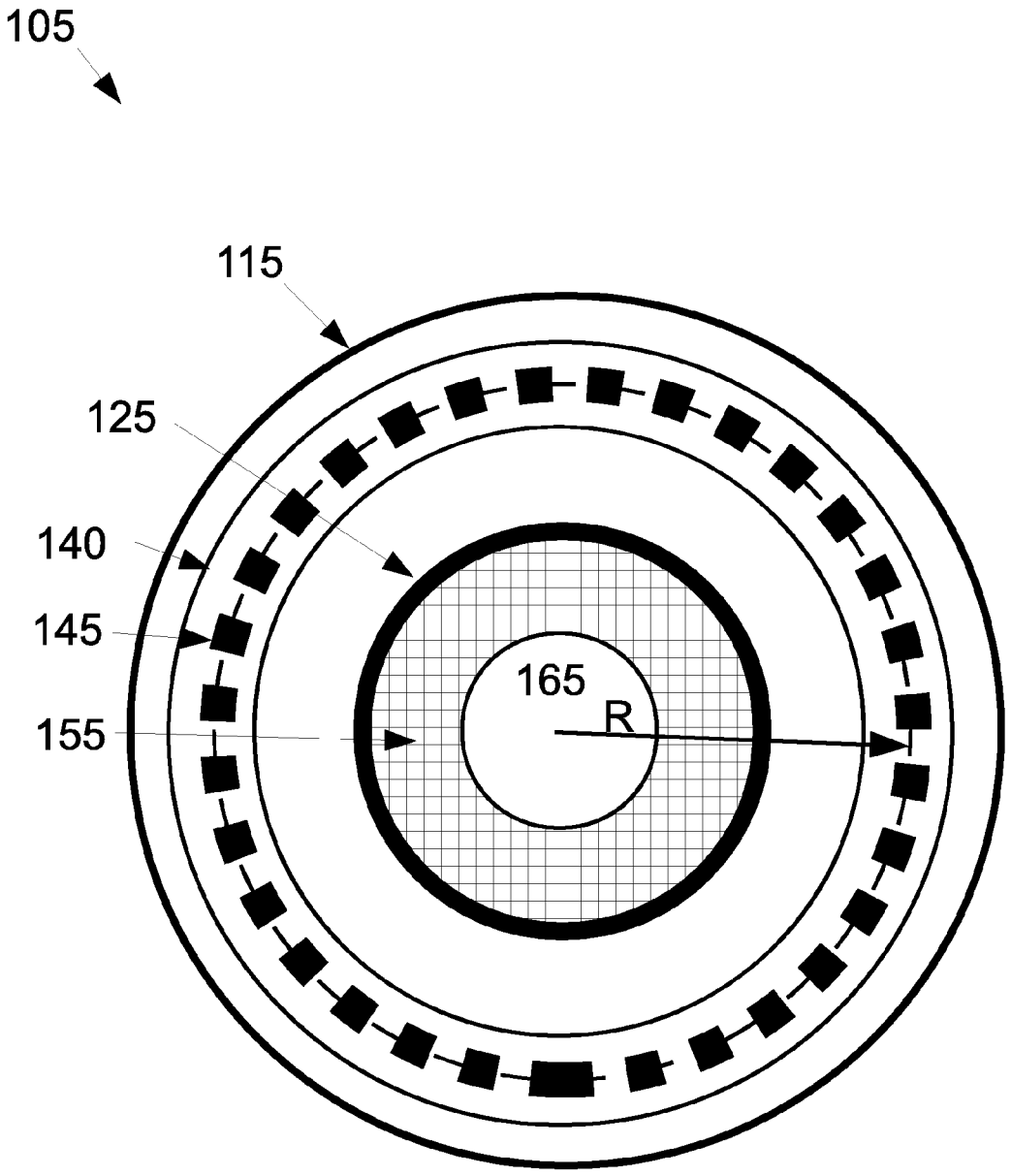
FIG. 2 shows a top view of an exemplary upper basin (105) of an embodiment of the fire and water fountain (100).

FIG. 2 shows a top view of an exemplary upper basin (105) of an embodiment of the fire and water fountain (100). Comprising an exemplary upper basin (105) as shown in FIG. 2 are an upper basin outer wall (115), an upper basin inner wall (125), a fluid distribution ring (140), a fluid distribution port (145), a continuous scupper (155), and the cascade chamber (165).

The upper basin outer wall (115) provides an outer containment for the fluid within the upper basin (105). In a preferred embodiment, the upper basin outer wall (115) is circular, although the configuration (round, square, rectangular, etc.) of the upper basin outer wall (115) is not as significant to the effective operation of the fire and water fountain (100).

Also within the upper basin (105) is the upper basin inner wall (125). The upper basin (105) and the upper basin inner wall (125) (together with the upper basin bottom (110)), shown in FIG. 3) provide containment for the fluid flowing through the fire and water fountain (100).

In a preferred embodiment, the upper basin inner wall (125) is circular. A circular configuration of the upper basin inner wall (125) is important because the upper basin inner wall (125) affects the flow characteristics of the fluid in the upper basin (105) and the circular cascade sheet.

The upper basin (105) receives fluid from the pump (205) and delivery tube (210) through a fluid supply port (130, shown in FIG. 3) into the fluid distribution ring (140). As shown in FIG. 2, the distribution ring (140) lies within the upper basin (105) between the upper basin outer wall (115), and the upper basin inner wall (125). Though shown as completely circular (i.e., 360-degrees within the upper basin (105)) the fluid distribution ring (140) may be less than completely circular. In the preferred embodiment, the fluid distribution ring (140) is nearly completely circular, i.e., in the range of 345 degrees to 360 degrees. As described below, the fluid distribution ring (140) provides better flow characteristics than a fluid distribution ring (140) that is not nearly completely circular.

Within the fluid distribution ring (140) is the fluid distribution port (145). The fluid distribution port (145) is an exit port into the upper basin (105) for fluid entering the fluid distribution ring (140). As with the fluid distribution ring (140), the fluid distribution port (145) is nearly completely circular in the preferred embodiment, and for the same reason.

Also shown in FIG. 2 are an exemplary continuous scupper (155) and an exemplary cascade chamber (165). An outer edge of the continuous scupper (155) sits on top of the upper basin inner wall (125). R is the Radius of the continuous scupper inner edge. There are several embodiments of the continuous scupper (155), which are discussed in greater detail in FIG. 5. As discussed above and below, the fluid in the upper basin (105) flows over the continuous scupper (155). On reaching the inner edge of the continuous scupper (155), which in this embodiment is above the cascade chamber (165), the fluid flows downwards (as shown in FIG. 1), into the cascade chamber (165).

Figure 3:
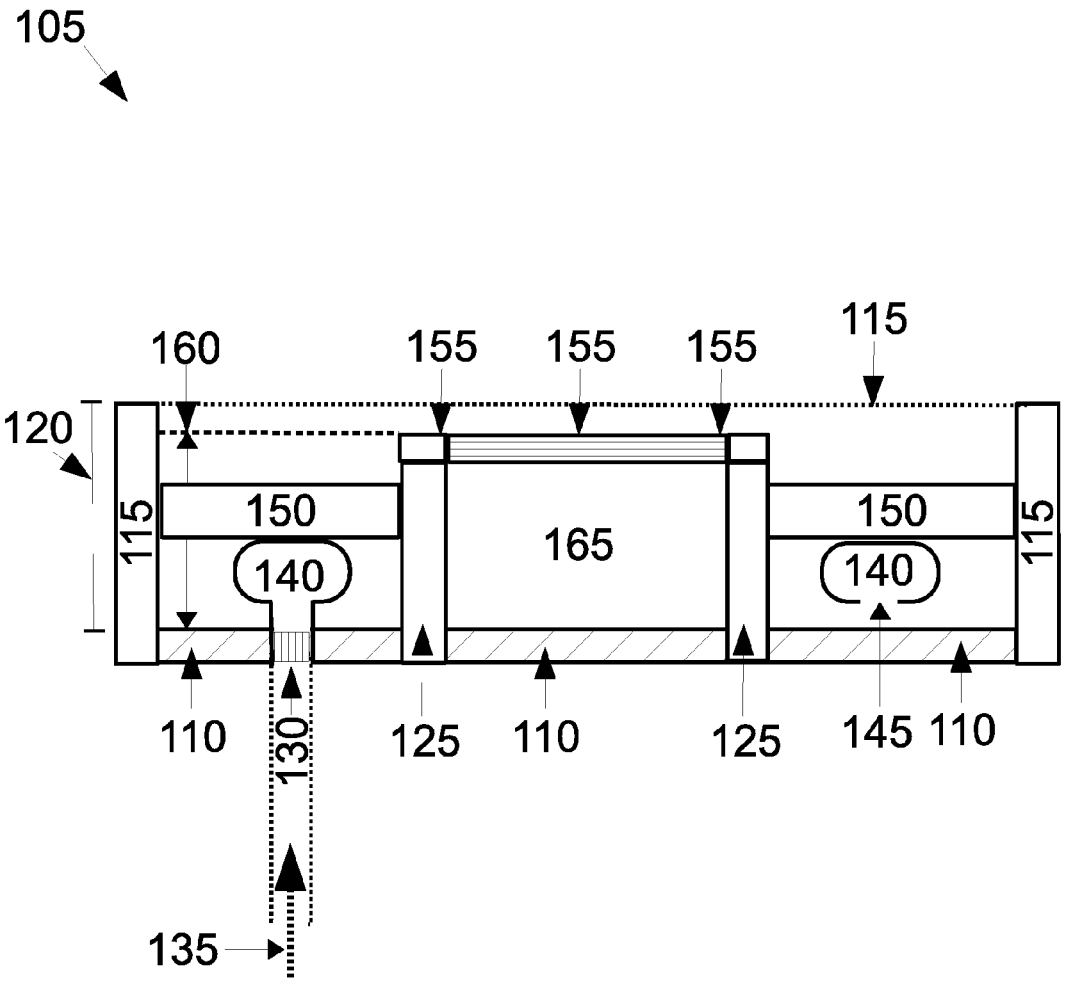
FIG. 3 shows a cut-away side view of an exemplary upper basin (105) of an embodiment of a fire and water fountain (100).
Figure 4:
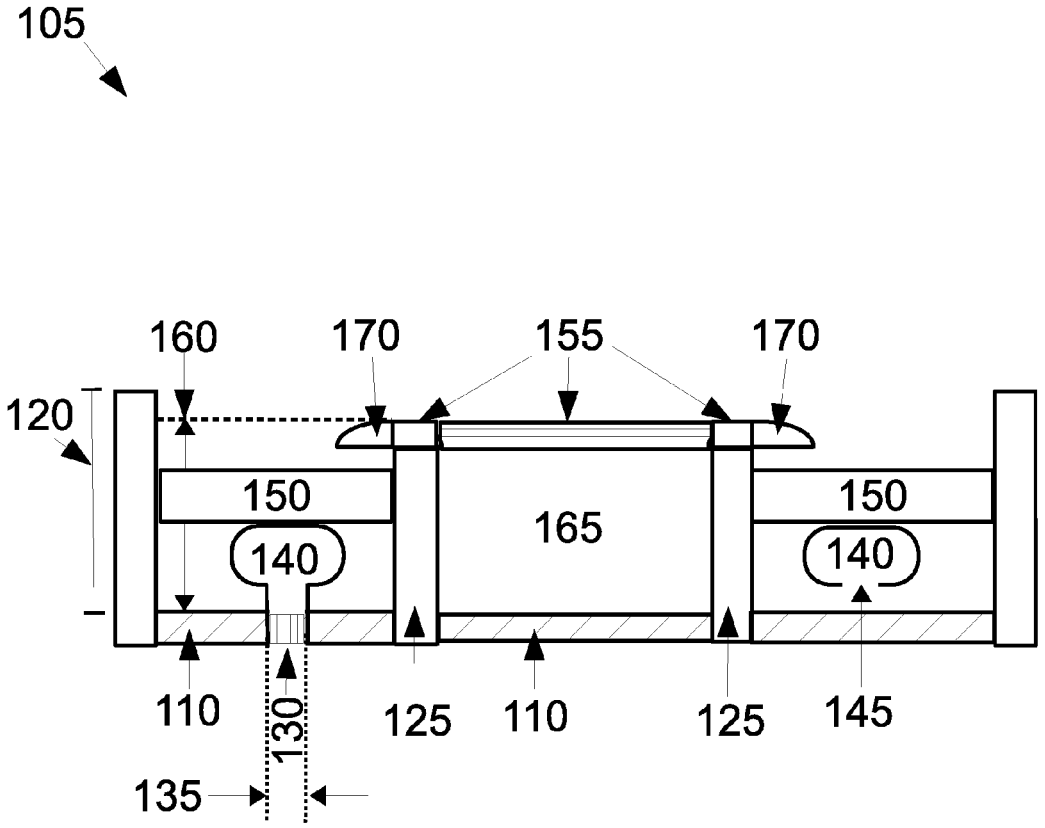
FIG. 4 shows a cut-away side view of an alternative embodiment of an upper basin (105) of a fire and water fountain (100).

Surrounding the cascade chamber (165) is the upper basin inner wall (125). As with the upper basin inner wall (125), a circular cascade chamber (165) is the preferred embodiment. FIGS. 3 and 4 show the cascade chamber (165) in greater detail.

FIG. 3 shows a cut-away side view of an exemplary upper basin (105) of an embodiment of a fire and water fountain (100). Among the components shown in FIG. 3 are a upper basin bottom (105), an upper basin outer wall (115), an upper basin outer wall height (120), an upper basin inner wall (125), a fluid supply port (130), a flow characteristic (135), a fluid distribution ring (140), a fluid distribution port (145), a fluid distribution media (150), a continuous scupper (155), a combined height (160), and a cascade chamber (165).

The upper basin bottom (110) serves as a lower containment barrier to the fluid in the upper basin (105). The upper basin bottom (110) may be manufactured of any non-permeable material. Metals such as copper, brass, or steel, may be used as they are relatively easy to work with and lightweight. The upper basin bottom (110) may be made of concrete, or other building materials, with appropriate concerns for their permeability, durability or weight.

The upper basin bottom (110) also serves as part of the support structure of the upper basin (105). In some embodiments, stanchions support the upper basin (105). These stanchions may be connected between the lower basin (200) and the upper basin (105) at the upper basin bottom (110), or the upper basin outer wall (120). In some embodiments, one or more fluid delivery tubes (210) serves as a stanchion through its connection to the upper basin bottom (110).

The general configuration of the upper basin bottom (110) is of a flat plate with an outer edge to align with the upper basin outer wall (115) and a hollow center to align with the upper basin inner wall (125) and the cascade chamber (165). In some embodiments, the upper basin bottom (110) is round. In some embodiments, the upper basin bottom (110) is square. In some embodiments, the upper basin bottom (110) is rectangular.

The upper basin bottom (110) also has a fluid supply port (130) penetrating it for the fluid delivery tube (210).

The upper basin outer wall (115) serves as the outer containment barrier to the fluid in the upper basin (105). The dotted line marked (115) in FIG. 3 is to show that the upper basin outer wall (115) circumferentially defines the upper basin (105), at the height of the dotted line.

The upper basin outer wall (115) may be manufactured of any non-permeable material. Metals such as copper, brass, or steel, may be used as they are relatively easy to work with and lightweight. The upper basin outer wall (115) may be made of concrete, or other building materials, with appropriate concerns for their use. In some embodiments, the upper basin outer wall (115) may be made of another material for aesthetic or structural considerations.

The outer configuration of the upper basin outer wall (115) is typically the same as the upper basin bottom (110). If the upper basin bottom (110) is round, the upper basin outer wall (115) is round. If the upper basin bottom (110) is square, the upper basin outer wall (115) is typically square. If the upper basin bottom (110) is typically rectangular, the upper basin outer wall (115) is typically rectangular. The configurations may be different (one round, one oval, etc.), when aesthetic or structural concerns dictate a different configuration.

Also attached to the upper basin bottom (110) is the upper basin inner wall (125). The upper basin inner wall (125) serves as the inner containment barrier to the fluid in the upper basin (105).

The upper basin inner wall (125) may be manufactured of any non-permeable material. Metals such as copper, brass, or steel, may be used as they are relatively easy to work with and lightweight. The upper basin inner wall (125) may be made of concrete, or other building materials, with appropriate concerns for their use. In some embodiments, the upper basin inner wall (125) may be made of another material for aesthetic or structural considerations.

The general configuration of the upper basin inner wall (125) is cylindrical. The upper basin inner wall (125) also serves as a support structure for the continuous scupper (155), the border for the cascade chamber (165), and as a support structure for the prescupper (170) (discussed in FIG. 4).

Like other fountains, the fire and water fountain (100) may be constructed in several size versions. The fire and water fountain (100), however, differs significantly from other fountains in that the fire and water fountain (100) is an inwardly flowing fountain. To achieve this inward flow, the upper basin outer wall height (120) must be higher than the exit of the fluid, which occurs at the upper basin inner wall (125).

The fluid supply port (130) is the entry port for fluid from the lower basin (200) to the upper basin (105). In a preferred embodiment, the fluid supply port (130) is one hole through the upper basin bottom (110) and connected to the fluid delivery tube (210). In some embodiments, the fluid supply port (130) may be two or more holes through the upper basin bottom (110) and connected to one or more fluid delivery tubes (210).

An important aspect of the fire and water fountain (100) is matching the fluid flow rate and flow characteristic through the fluid delivery port (130) to the desired flow characteristics through the cascade chamber (165) of the fire and water fountain (100). One of the factors for consideration is the size of the fluid supply port (130).

To achieve proper flow characteristics, the fluid supply port (130) should be of a size proportional to the flow characteristic (135). The flow characteristic (135) is similar to a vector, i.e., it is not a specific dimension, but represents a proportionality to the fluid flow rate through each portion of the fire and water fountain (100), as will be discussed further. Another use of the flow characteristic would be for determining the proper distance between the fluid distribution ring (140) and the upper basin bottom (110).

Also shown in FIG. 3 is the fluid distribution ring (140). The fluid distribution ring (140) receives fluid from the fluid supply port (130) and distributes the fluid to the fluid distribution port (145). The fluid distribution ring (140) may be manufactured of any non-permeable material. Metals such as copper, brass, or steel, may be used as they are relatively easy to work with and lightweight. As with the fluid supply port (130), the size (as proportional to the flow rate) of the fluid distribution ring (140) should be identical or close to the flow characteristic (135). Matching the size (e.g., cross-sectional area) of the fluid distribution ring (140) to the fluid delivery port (130) is important so that the flow rate is balanced to achieve a laminar fluid flow into the cascade chamber (165). If the flow rate is too low, the fluid entering the cascade chamber will break apart in a dribble pattern. If the flow rate is too high, the fluid flow over the continuous scupper (155) will not be laminar.

Also shown in FIG. 3 is the fluid distribution port (145). The fluid distribution port (145) receives fluid from the fluid distribution ring (140) and distributes the fluid around the upper basin (105). In a preferred embodiments, the fluid distribution ring (145) is a slot or a plurality of slots. In some embodiments, the fluid distribution port (145) is a plurality of holes. As with the fluid supply port (130) and the fluid distribution ring (140), the size of the fluid distribution port (145) (as proportional to the flow rate) should be proportional to the flow characteristic (135).

In an embodiment using holes, the fluid distribution ring port holes (145) are of equal size and equal spacing and the fluid distribution ring port (140) is mounted above the upper basin bottom (110) no closer than the diameter of the fluid distribution ring holes (145). For example, for a 1.5-inch diameter fluid distribution ring (140), with five holes for the fluid distribution ring port (145), equal flow rate occurred if each hole was 0.85 inches in diameter. Above that size, uneven flow occurred.

Also shown in FIG. 3 is the fluid distribution media (150). The fluid distribution media (150) provides a slight back-pressure and flow dispersion to the fluid so that turbulent currents from the fluid distribution port (145) are converted to near laminar fluid flows.

The fluid distribution media (150) may be metal, paper, or other material. Unlike the upper basin outer wall (115), upper basin inner wall (125), or fluid distribution ring (140), the fluid distribution media (150) may be made of non-permeable material with permeable portions or permeable material. The fluid distribution media (150) must, however, be made of a durable material to withstand the fluid currents, unless the fluid distribution media (150) is intended for temporary use.

In some embodiments, the fluid distribution media (150) is one or more fine sieves. In some embodiments, the fluid distribution media (150) may be one or more different mesh sieves. A coarse fluid distribution media (150) may be near the fluid distribution ring (140) with a finer fluid distribution media (150) on the other side of the coarse fluid distribution media (150). The coarse fluid distribution media (150) may include commercial materials such as woven plastic pads or other commercial materials that would disperse fluid flow around the upper basin (105) and contribute to laminar flow.

The fluid distribution media (150) may also be a plurality of round or semi-round natural objects, such as stones, rocks, or sand with fine distribution media on top of coarse distribution media. Marbles may also be used.

Also shown in FIG. 3 is the continuous scupper (155). The continuous scupper (155) is a key component of the fire and water foundation (100). In general, a scupper is a defined path that discharges a fluid, such as rain from a pathway, building or a vessel. Most often a scupper is flat and three-sided and the rain falls wherever the flow-rate, gravity and the height of the scupper take the rain. Many scuppers must be used with troughs to direct the rain away from people and from areas that cannot withstand the erosion of falling or running water.

The continuous scupper (155) of the fire and water fountain (100) is distinctly different both in form and function. Though the continuous scupper (155) provides an exit path of the fluid from the upper basin (105), the preferred embodiment of the continuous scupper (155) has a circular outer edge with a hollow center so that the fluid flows inward toward a central point, i.e., the cascade chamber (165), and the continuous scupper (155) applies a surface tension (i.e., drag) affect to the fluid to thin the fluid into a continuous laminar sheet that falls through the cascade chamber (165) with a specifically designed 3-dimenional shape. One of these 3-dimenional designs is represented in FIG. 1.

The continuous scupper (155) sits on top of the upper basin inner wall (125). In some preferred embodiments, the continuous scupper (155) extends over the cascade chamber (165). In other preferred embodiments, the continuous scupper (155) extends into the cascade chamber (165). Various designs for the continuous scupper (155) are shown in FIG. 5. The continuous scupper (155) may be made from any material. Metals such as copper, brass, or steel, may be used as they are relatively easy to work with and lightweight.

Other materials may be used as with appropriate concerns for their permeability, durability or weight and aesthetic or structural considerations.

Also shown in FIG. 3 is the combined height (160). The combined height (160) is another key component of the fire and water foundation (100). As shown by FIG. 3, the combined height (160) is the sum of the height of the upper basin inner wall (125) above the upper basin bottom (110) and the height of the continuous scupper (155). As also shown by FIG. 3, the combined height (160) is less than the height (120) of the upper basin outer wall (115) above the upper basin bottom (110). This height difference directs the flowing fluid to flow over the continuous scupper (155) and then into the cascade chamber (165), rather than over the upper basin outer wall (115). In this way, the design of the continuous scupper (155) has an affect on the flow path of the falling fluid.

Also shown in FIG. 3 is the cascade chamber (165), which is a pathway formed by the upper basin inner wall (125) into which the fluid falls from the continuous scupper (155). The cascade chamber (165) has a diameter equal to the diameter formed by the upper basin inner wall (125), and a depth equal to the combined height (160) plus the thickness of the upper basin bottom (110). Though the size of the cascade chamber (165) is not as critical as those of the upper basin outer wall (115) and the combined height (160), the cascade chamber (165) must be sufficiently large so that the fluid flowing onto and falling off the continuous scupper (155) does not cross the mid-line (not shown) of the cascade chamber (165) and intersect, thus causing a splashing effect.

FIG. 4 shows a cut-away side view of an alternative embodiment of a fire and water fountain. FIG. 4 is substantially the same as FIG. 3, with two exceptions. These are that the line representing the combined height (120) of the upper basin outer wall (115) is removed for clarity, and FIG. 4 shows a prescupper (170).

As shown in FIG. 4, the prescupper (170) serves as an extension surface to the fluid before the fluid reaches the continuous scupper (155). The prescupper (170) provides additional surface area on which to increase drag on the fluid, thus thinning the fluid thickness before the fluid reaches the continuous scupper (155).

This prescupper (170) extension surface is beneficial in fire and water fountains (100) where the continuous scupper (155) surface area is insufficient to thin the fluid to a laminar condition before the fluid falls off the continuous scupper (155). These circumstances may exist with smaller fire and water fountains since surface area is proportional to the square of the radius, and with higher flow rates where drag is similarly an exponential function. These circumstances may also exist with a continuous scupper (155) that by shape or by vertical angle is insufficient to thin the fluid to a laminar condition before the fluid falls off the continuous scupper (155), as shown in FIG. 5.

FIGS. 5A, 5B, 5C, 5D, 5E and 5F show alternative embodiments of continuous scuppers (155) of a fire and water fountain (100).

Figure 5A:
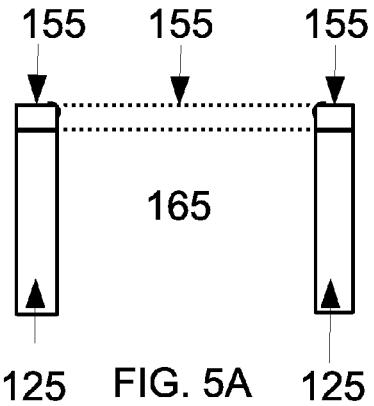
FIGS. 5A, 5B, 5C, 5D, 5E and 5F show alternative embodiments of continuous scuppers (155) of a fire and water fountain (100).

FIG. 5*a* shows an embodiment of a continuous scupper (155) in which the fluid flows over and off the continuous scupper (155) with next to no horizontal velocity and thus flows down the walls of the cascade chamber. In a preferred embodiment, the upper corner of the inner edge of the continuous scupper (155) is rounded.

Figure 5B:
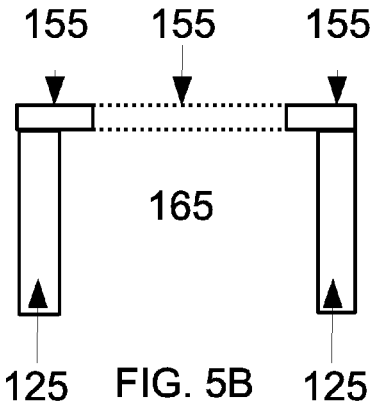

FIG. 5*b* shows an embodiment of a continuous scupper (155) in which the fluid flows over and off the continuous scupper (155) with minimal horizontal velocity.

Figure 5C:
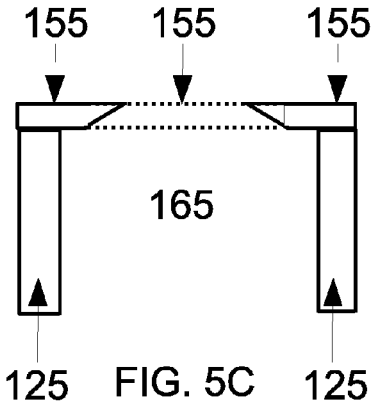

FIG. 5*c* shows an embodiment of a continuous scupper (155) in which the fluid flows over and off the continuous scupper (155) with moderate horizontal velocity. The angular tip of the continuous scupper (155) greatly reduces fluid dripping.

Figure 5D:
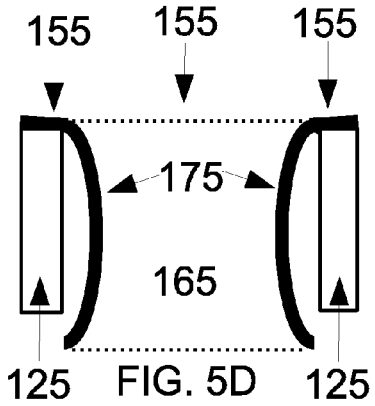

FIG. 5*d* shows an embodiment of a continuous scupper (155) known as a contour continuous scupper (175). With this embodiment, the continuous scupper outer edge is higher than the continuous scupper lower edge. The fluid flows over and then down the continuous scupper (155) and is then imparted with angular momentum by slope of the contour continuous scupper (175). With the proper flow rate, this embodiment of the continuous scupper (155) produces a circular cascade sheet that resembles a champagne flute. In some embodiments, as shown in FIG. 5*d*, the continuous scupper (155) extends below the upper basin bottom (110). (This is the Vesuvius model).

Figure 5E:
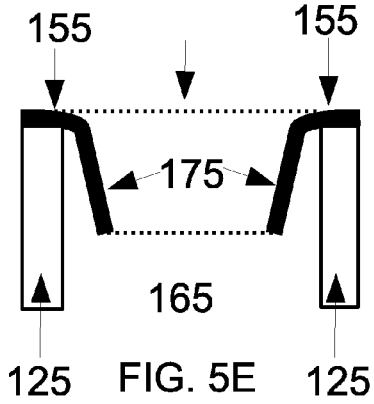

FIG. 5*e* shows another embodiment of a contour continuous scupper (175). The fluid flows over and then down the continuous scupper (15), then flows with some inward angular momentum. With the proper flow rate, this embodiment of the contour continuous scupper (175) produces a rifled (i.e., twisted) circular cascade sheet. The vertical and horizontal angles can be adjusted to launch the fluid further inwards.

Figure 5F:
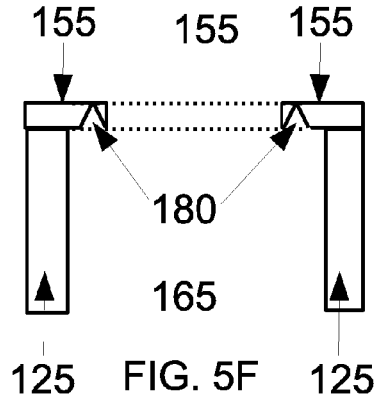

FIG. 5*f* shows an embodiment of a continuous scupper (155) with a notched tip (180). A notched tip (180) is beneficial during low flow conditions of startup and shutdown of the fire and water fountain (100) to prevent dripping. The notched tip (180) may be used with most continuous scuppers (155).

Figure 6:
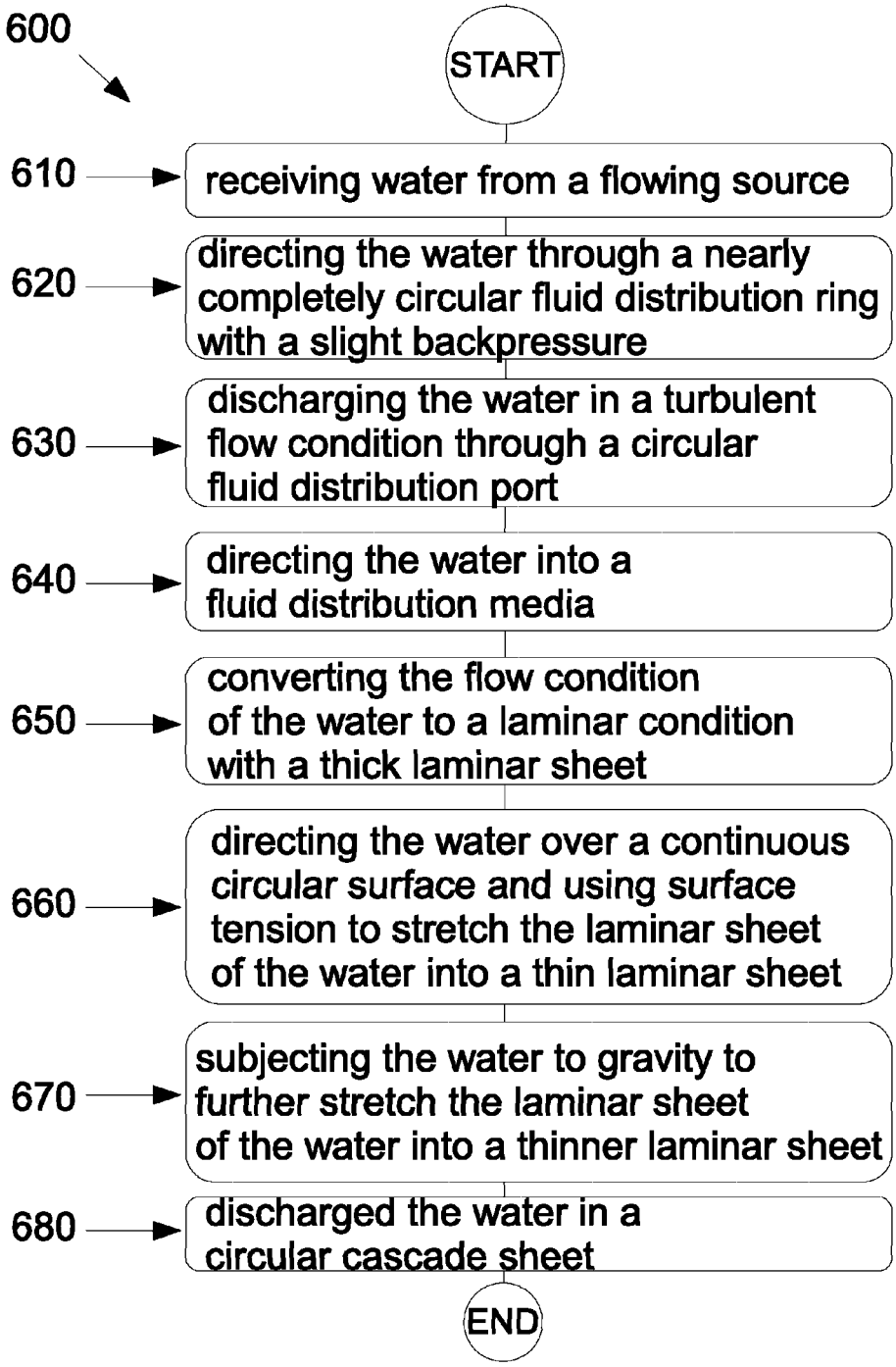
FIG. 6 shows a method for directing falling water into a circular cascade sheet.

FIG. 6 shows a method for directing falling water into a circular cascade sheet.

At step 610, water is received from a flowing source.

At step 620, the water is directed through a nearly completely circular fluid distribution ring with a slight backpressure.

At step 630, the water is discharged in a turbulent flow condition through a circular fluid distribution port.

At step 640, the water is directed into a fluid distribution media.

At step 650, the flow condition of the water is converted to a laminar condition with a thick laminar sheet.

At step 660, the water is directed over a continuous circular surface and using surface tension to stretch the laminar sheet of the water into a thin laminar sheet.

At step 670, the water is subjected to gravity to further stretch the laminar sheet of the water into a thinner laminar sheet.

At step 680, the water is discharged in a circular cascade sheet.

Engineering of the fire and water fountain (100) includes multiple principles of physics.

Among these principles is that flow rate (Q) is proportional to the fluid velocity (V) and the cross-sectional area (A) of the fluid flow container, i.e., $Q=V*A$. In the fire and water fountain (100) the flow rate Q1 from the pump is equal to Q2 through the fluid delivery tube (210) to the upper basin (105), i.e., $Q1=Q2$.

Similarly, the flow rate Q2 from the fluid delivery tube (210) must be equal to the flow rate Q3 into the fluid distribution ring (140) and through the fluid distribution port (145) into the upper basin (105), i.e., $Q2=Q3$.

Likewise, the flow rate Q3 from the fluid distribution port (145) must be equal to the flow rate Q4 over the continuous scupper (155) and the flow rate Q5 through the cascade chamber (165), i.e., Q3=Q4=Q5.

Consequently, Q1=Q2=Q3=Q4=Q5.

The basic formula for flow rate though a circular tube is the fluid velocity times the cross-sectional area of the tube, i.e., Q=V*A where the Area=pi times the square of the radius (Rt) of the circular tube, A=Π*Rt^2.

If the cross-sectional areas of the pump discharge (205), the fluid delivery tube (210), the fluid distribution ring (140) and the fluid distribution port (145) are kept the same, then the flow rates will be equal.

Similarly, if a slot is used in the fluid distribution port (145), then the area of the slot would be equal to the cross-sectional area of the fluid delivery tube (210) to maintain the same velocity. In a preferred embodiment, however, the cross-sectional area of the fluid distribution port (145) is larger than the cross-sectional area of the fluid delivery tube (210). The increase in cross-sectional area decreases the velocity of the fluid flowing into the upper basin (105).

If holes are used in the fluid distribution port (145), then a slight backpressure is used within the fluid distribution ring (140) to create equal flow rate from each hole. In this instance, there is also an equation describing the radius of each fluid distribution port (145). This equation is r=(Q/(n*pi*V))^1/2, in which Q is the flow rate into the fluid distribution ring (140), n is the number of holes and V is the flow velocity through the fluid distribution ports (145).

The basic formula for flow rate over a flat surface is velocity times the thickness (T) of the fluid sheet times the width (W) of the fluid sheet, i.e., Q=V*A=V*T*W.

In an incompressible flowing fluid, the values are co-dependent, i.e., the thickness (T) of the fluid sheet is proportional to the fluid velocity, the width (W) of the available flow area, and the density and viscosity of the fluid. In addition, the width (W) of the available flow area over the continuous scupper (155) is dependent on the radius (Rs) of the continuous scupper (155) at the point of exit, W=2*Π*Rs. At this point, Q4=V*T*2*Π*Rs.

In instances where the fluid distribution ports (145) are holes, another equation describes the continuous scupper inner edge radius. This equation is R=(n*A*V2)/(2*pi*T*V3), where R is the Radius of the continuous scupper inner edge, n is the number of hole in the fluid distribution ring (140), A is the Area of each fluid distribution port hole (145), V2 is the flow velocity from each fluid distribution port hole (145), T is the thickness of the fluid flowing over the continuous scupper (155), and V3 is the flow velocity over the continuous scupper (155). If the fluid distribution port (145) is not a plurality of holes then, n=1.

In addition, the flow rate Q4 of the fluid into the circular cascade sheet must be large enough to maintain continuity (i.e., the appearance) of the circular cascade sheet, i.e., without breaking apart, keeping in mind that gravity (g=32.2 ft/sec/sec) will accelerate the falling fluid. Hence, the flow rate Q4=Q5=V*A=V*T*2*Π*Rc, where Rc is the radius of the circular cascade sheet. Depending on which continuous scupper (155, 175, etc.) is used, the Rc is the radius of the circular cascade sheet is equal to than the radius (Rs) of the continuous scupper (155) at the point of exit.

As Q4=Q5 where Q4=V*T*2*Π*Rs, and Q5=V*A=V*T*2*Π*Rc, then the relative variables are V*T*Rs=V*T*Rc. Consequently, as the velocity of the falling fluid increases, the circular cascade sheet thickness decreases.

To maintain laminar flow with a relatively clear circular cascade sheet, the Reynolds number of a flowing fluid should be less than 2000. The formula for a Reynolds number (Rn) of a flowing fluid in a pipe is Rn=(V*D*p)/n, where V is the velocity of the flow, D is the diameter of a pipe, p is the density of fluid, and n is the dynamic viscosity of the fluid. This equation reduces to Rn=(V*D)/v where v is the kinematic viscosity of the fluid.

Based on the circular configuration of the continuous scupper (155), the maximum Reynolds number for the fire and water foundation (100) is approximately 2300. An important consideration is that the flow rate Q1 from the pump (205) has to be matched to the size of the continuous scupper (155) and the height of the cascade sheet. To maintain laminar flow with a relatively clear circular cascade sheet, the maximum velocity (Vmax) of the falling fluid is a function of the kinematic viscosity of the fluid and the Thickness of the fluid, i.e., Vmax=2300 v/T.

Another equation describes the height Z of the circular cascade sheet. This equation is Z =((X/tan(90-theta))+((½)*g*X^2)/(V^2*sin ^2(90-theta)) where X is the horizontal distance from the wall of the cascade column, theta is the angle between the horizontal and continuous scupper inner edge, and V is the Velocity of the fluid as it exits the continuous scupper inner edge. If X equals or is greater than R (the Radius of the continuous scupper inner edge) then the fluid will collide at the bottom of the circular cascade sheet.

Though calculations may be made to determine whether a laminar flow condition would exist through the circular cascade sheet, determination of laminar flow is also visually detectable by a glassy appearance in the upper basin (105).

Consequently, the size of the components of the fire and water fountain is related. Based on these relationships, the characteristics of certain components have been determined. These characteristics may be used to approximately determine other components. For standardization, model names have been given to certain configurations.

Fire and Water Fountain Upper Basin Specifications (Values are Approximate) There is a relationship between the flow rate and the circumference of the continuous scupper as demonstrated by the chart below.

| Fountain Name | Continuous Scupper Circumference at Exit (Inches) | Cascade Height (Inches) |
|---|---|---|
| Vesuvius | 6.28 | 7.5 |
| Tambora | 26.75 | 14 |
| Mauna Loa | 44.5 | 22 |
| Krakatoa | 76 | 19 |
| The Duke | 104 | 40 |

An advantage of the fire and water fountain (100) is that commercial pumps, even pool pumps, may be used.

| Model Name | Approximate Flow Rate GPH | Lower Basin Capacity (gallons) | Cycles per Hour |
|---|---|---|---|
| Vesuvius | 275-300 | 0.75 | 400 |
| Tambora | 1300-1790 | 3 | 433 |
| Mauna Loa | 4500-4900 | 10 | 450 |
| Krakatoa | 7500 | 80 | 93 |
| The Duke | 9100-10000 | 120 | 83 |

Submersing the pump helps to dampen pump vibration and noise as well as to keep the unit self-contained, which allows for easy relocation. Ideally the pump does not touch any part of the structure except through the supply manifold. Dampening the pump vibrations to the structure is helpful, but is not required to for the fire and water fountain to produce a circular cascade sheet.

The fire and water fountain (100) may also be incorporated into nature. Based on an approximate flow rate in a natural waterway of 51,000 GPH and a drop height of 216 inches, the continuous scupper circumference at the cascade chamber edge would be 665 inches.

Figure 7:
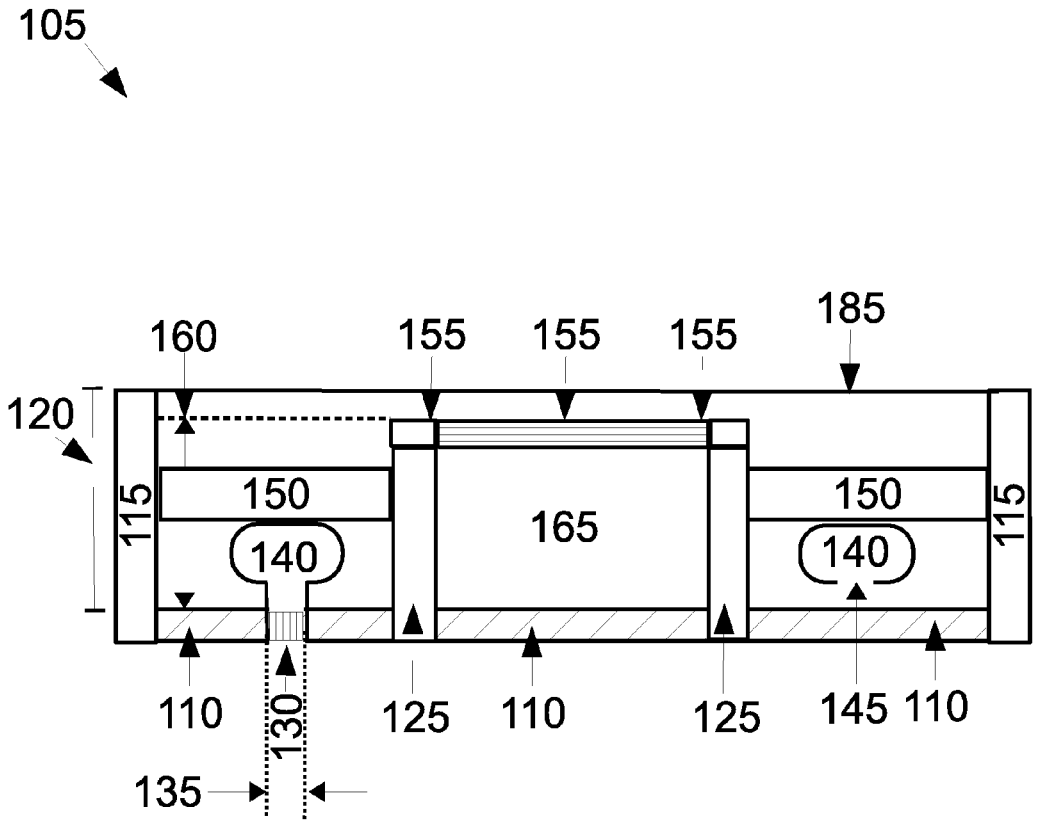
FIG. 7 shows an alternative embodiment of a fire and water fountain (100) with an upper basin top cover (185).

FIG. 7 shows an alternative embodiment of a fire and water fountain (100) with an upper basin top cover (185). The upper basin top cover (185) seals the upper basin (105) so the fluid does not spill over the upper basin outer wall (115). In this embodiment, the flow rate may be on the upper end of the laminar range.

Figure 8:
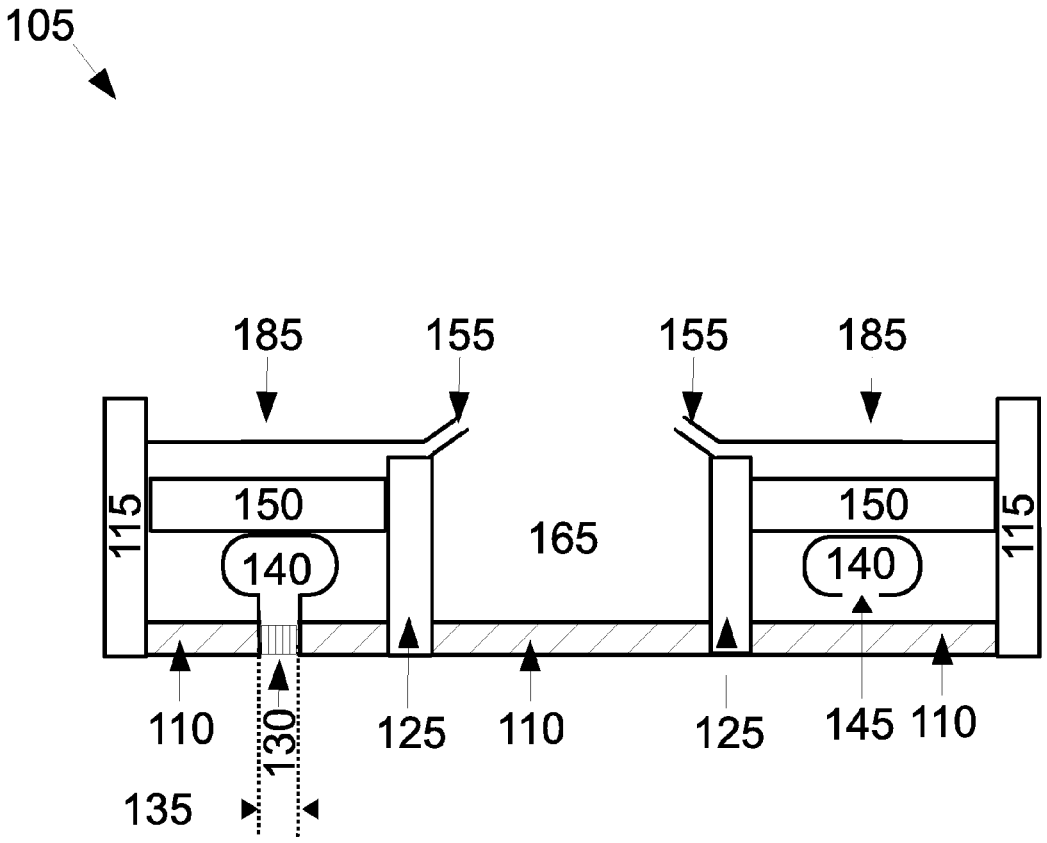
FIG. 8 shows an alternative embodiment of a fire and water fountain with an upper basin top cover (185) and a continuous scupper (155) with a circular outer edge is above the continuous scupper circular lower edge.

FIG. 8 shows an alternative embodiment of a fire and water fountain (100) with an upper basin top cover (185) and a continuous scupper (155) with a circular outer edge is below the continuous scupper inner edge. In this embodiment, a fire and water fountain (100) can send fluid upward to achieve a circular cascade sheet falling from above the upper basin.

Figure 9:
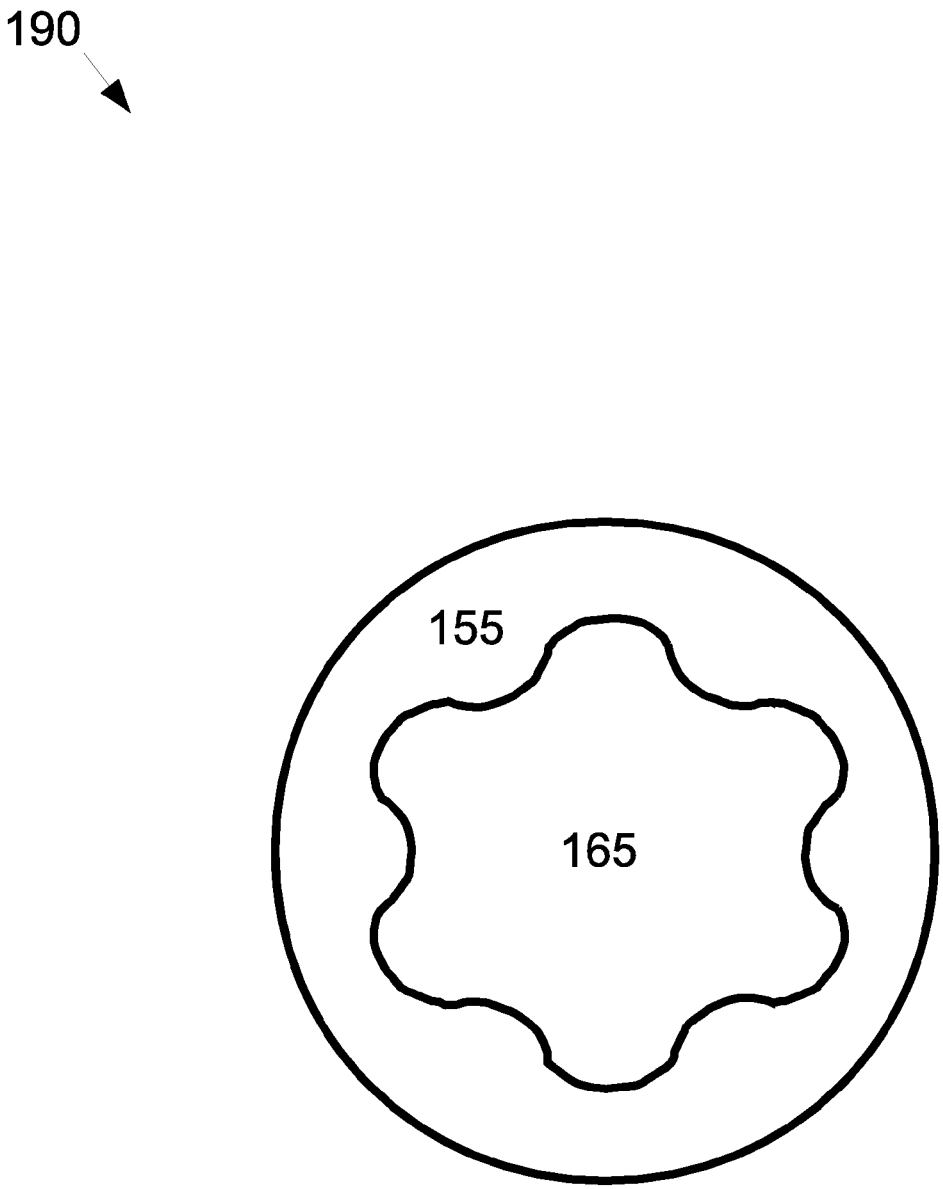
FIG. 9 shows an alternative embodiment of a fire and water fountain (100) with a continuous scupper (155) having alternately inward and outward scalloped edges.

FIG. 9 shows an alternative embodiment of a fire and water fountain (100) of a continuous scupper (155) having alternately inward and outward scalloped edges. In this embodiment, a fire and water fountain can create an intricate circular cascade sheet having multiple semi-circular areas.

In a preferred embodiment, the fire and water fountain (100) comprises:

a hollow upper basin (105) having an upper basin bottom (110) having a cylindrical hollow center and connected at an outer edge to an upper basin outer wall (115) having an upper basin outer wall height (120) above the upper basin bottom (110), with the upper basin bottom (110) connected at an inner edge to an upper basin inner wall (125) that forms a cylindrical hollow center in the upper basin (105), with a fluid distribution ring (140) affixed to and within the upper basin (105) and located approximately a distance proportional to a flow characteristic (135) from and approximately parallel to the upper basin bottom (110) with the fluid distribution ring (140) located between the upper basin outer wall (115) and the upper basin inner wall (125), with at least one water supply port (130) perforating the upper basin bottom (110), with the water supply port (130) sized proportional to a flow characteristic (135), with at least one fluid distribution port (145) having an area proportional to the flow characteristic (135) and perforating the fluid distribution ring (140), with a fluid distribution media (150) distributed within the upper basin (105) and proximate to the fluid distribution ring (140) and between the upper basin outer wall (115) and the upper basin inner wall (125), and a continuous scupper (155) comprising an circular outer edge located on top of the upper basin inner wall (125) and positioned so that the upper basin outer wall height (120) is more than a combined height (160) which comprises a sum of a thickness of the continuous scupper (155) and a height of the upper basin inner wall (125), with a inner edge which is located approximately center to a cascade chamber (165) which is located centrally within the upper basin (105) with the cascade chamber (165) circumferentially bounded by the upper basin inner wall (125).

In some embodiments, the fire and water fountain (100) further comprises a prescupper (170) positioned adjacent to the continuous scupper (155) and the upper basin inner wall (125).

In some embodiments of the fire and water fountain (100), the continuous scupper (155) circular outer edge is above the continuous scupper circular lower edge.

In some embodiments of the fire and water fountain (100) the continuous scupper (155) inner edge comprises alternating inward and outward scalloped edges.

In some embodiments of the fire and water fountain (100) the continuous scupper (155) inner edge has alternately inward and outward scalloped edges and alternately upward and downward scalloped edges.

In some embodiments of the fire and water fountain (100) there is a triangular tip on the continuous scupper (155) inner edge.

In some embodiments of the fire and water fountain, there is a notch tip (180) on the continuous scupper (155) inner edge.

In some embodiments of the fire and water fountain, the fluid distribution ring (140) is a toroid substantially concentric with the upper basin (105) with a radius proportional to the flow characteristic (135).

In some embodiments of the fire and water fountain (100), the fluid distribution port (145) has a fluid exit dimension proportional to the flow characteristic (135).

In some embodiments of the fire and water fountain (100), the fluid distribution media (150) comprises at least one sieve.

In some embodiments of the fire and water fountain (100), the fluid distribution media (150) comprises a plurality of approximately parallel circular perforated plates.

In some embodiments of the fire and water fountain (100), the fluid distribution media (150) comprises natural material.

In some embodiments of the fire and water fountain (100), the fluid distribution media (150) comprises paper filter media.

In some embodiments of the fire and water fountain (100), the fluid distribution media (150) comprises plastic filter media.

In some embodiments of the fire and water fountain (100), the flow characteristic (135) is a dimension less than one inch.

In some embodiments of the fire and water fountain (100), the flow characteristic (135) is a dimension approximately one inch.

In some embodiments of the fire and water fountain (100), the flow characteristic (135) is a dimension more than one inch.

In some embodiments of the fire and water fountain (100), the flow characteristic (135) is an area less than one square inch.

In some embodiments of the fire and water fountain (100), the flow characteristic (135) is an area approximately one square inch.

In some embodiments of the fire and water fountain (100), the flow characteristic (135) is an area greater than one square inch.

In some embodiments of the fire and water fountain (100), the fluid distribution ring (140) has a substantially circular perimeter.

In some embodiments of the fire and water fountain (100), a fire fixture is located below the cascade chamber (165).

In some embodiments of the fire and water fountain (100), a fire fixture is located within the cascade chamber (165).

In some embodiments of the fire and water fountain (100), the continuous scupper surrounds a fire fixture.

These descriptions and drawings are embodiments and teachings of the present invention. All variations are within the spirit and scope of the present invention. This disclosure is not to be considered as limiting the present invention to only the embodiments illustrated.

What is claimed is:

1. A method for directing falling fluid into a circular cascade sheet comprising:

receiving a fluid from a flowing source, directing the fluid through a fluid distribution ring having at least two fluid distribution ports with a slight back-pressure to create equal flow rate from each of the at least two fluid distribution ports, discharging the fluid in a turbulent flow condition through a fluid distribution port into a basin, directing the fluid into a fluid distribution media within the basin, converting the turbulent flow condition of the fluid to a laminar flow condition at an air-fluid surface of the fluid within the basin, directing the fluid over an annular scupper having an inner edge defining a hole and capable of applying a surface tension to the fluid to thin the fluid into a continuous circular laminar sheet having a continuous circular laminar sheet thickness, subjecting the fluid to drag at the inner edge of the annular scupper to further stretch the continuous circular laminar sheet of the fluid into a thinner continuous circular laminar sheet thickness, and subjecting the fluid to gravity while discharging the fluid over the inner edge of the annular scupper in a circular cascade sheet into a circular cascade chamber.

2. The method of claim 1 wherein converting the turbulent flow condition of the fluid to a laminar condition creates a laminar sheet flowing inward within the basin towards the annular scupper.

3. The method of claim 2 wherein the laminar sheet is a thick laminar sheet.

4. The method of claim 1 wherein the at least two fluid distribution ports is a slot.

5. The method of claim 1 further comprising: pressurizing the fluid to increase a flow rate of the fluid towards an upper end of a laminar range of the fluid.

6. The method of claim 5 wherein the step of pressurizing the fluid comprises positioning a basin top cover to seal the basin.

7. The method of claim 1 wherein the step of directing the fluid into a fluid distribution media comprises directing the fluid into at least one sieve.

8. The method of claim 1 wherein the step of directing the fluid into a fluid distribution media comprises directing the fluid into a plurality of objects having generally round surfaces.

9. The method of claim 1 wherein the step of directing the fluid into a fluid distribution media comprises directing the fluid into a plurality of approximately parallel circular perforated plates.

10. The method of claim 1 wherein the step of directing the fluid into a fluid distribution media comprises directing the fluid into a plurality of natural material.

11. The method of claim 1 wherein the step of directing the fluid into a fluid distribution media comprises directing the fluid into a filter media.

12. The method of claim 1 further comprising imparting a non-zero horizontal velocity onto the fluid such that the circular cascade sheet has an initial diameter approximate to a diameter of the inner edge of the annular scupper and the continuous circular laminar sheet thickness remains approximately constant as the diameter of the circular cascade sheet decreases as the circular cascade sheet descends into the circular cascade chamber.

* * * * *